US011499390B2

(12) United States Patent
Chen

(10) Patent No.: US 11,499,390 B2
(45) Date of Patent: Nov. 15, 2022

(54) SEALING ASSEMBLY FOR DISSOLVABLE BRIDGE PLUG, A DISSOLVABLE BRIDGE PLUG AND A SEALING METHOD FOR GAP

(71) Applicant: Aimin Chen, Beijing (CN)

(72) Inventor: Aimin Chen, Beijing (CN)

( * ) Notice: Subject to any disclaimer, the term of this patent is extended or adjusted under 35 U.S.C. 154(b) by 0 days.

(21) Appl. No.: 17/343,863

(22) Filed: Jun. 10, 2021

(65) Prior Publication Data

US 2022/0195830 A1 Jun. 23, 2022

(30) Foreign Application Priority Data

Dec. 21, 2020 (CN) ..... 202011518616.X
Dec. 21, 2020 (CN) ..... 202023099627.7

(51) Int. Cl.
*E21B 33/128* (2006.01)
*E21B 33/129* (2006.01)
*E21B 23/01* (2006.01)

(52) U.S. Cl.
CPC ..... *E21B 33/128* (2013.01); *E21B 33/1293* (2013.01); *E21B 23/01* (2013.01); *E21B 2200/08* (2020.05)

(58) Field of Classification Search
CPC ..... E21B 2200/08; E21B 33/128; E21B 33/1293; E21B 23/01; E21B 33/1216
See application file for complete search history.

(56) References Cited

U.S. PATENT DOCUMENTS

| | | | | |
|---|---|---|---|---|
| 9,260,936 | B1 * | 2/2016 | Branton | F16J 15/166 |
| 10,914,132 | B1 * | 2/2021 | Pang | E21B 33/1293 |
| 2018/0016864 | A1 * | 1/2018 | Parekh | E21B 33/1216 |
| 2020/0291739 | A1 * | 9/2020 | Zeng | E21B 33/1293 |
| 2020/0347694 | A1 * | 11/2020 | Power | E21B 33/129 |
| 2021/0332661 | A1 * | 10/2021 | Tonti | E21B 34/14 |

* cited by examiner

*Primary Examiner* — Robert E Fuller
*Assistant Examiner* — Theodore N Yao
(74) *Attorney, Agent, or Firm* — IPRO, PLLC

(57) ABSTRACT

A sealing assembly for a dissolvable bridge plug, a dissolvable bridge plug and a sealing method for a gap are disclosed. The sealing assembly for dissolvable bridge plug includes a seal ring and a support ring. The support ring includes at least two supporting parts capable of sliding in the radial direction relative to each other. An axial end face of the support ring is butted with an axial end face of the seal ring. Respective central holes of the support ring and the seal ring are capable of being sleeved outside a component of dissolvable bridge plug. The supporting parts of the support ring in an expansion state are capable of exerting an axial thrust on the seal ring to prevent the seal ring from deforming in the axial direction.

20 Claims, 10 Drawing Sheets

SEALING ASSEMBLY FOR DISSOLVABLE BRIDGE PLUG, A DISSOLVABLE BRIDGE PLUG AND A SEALING METHOD FOR GAP

CROSS REFERENCE TO RELATED APPLICATION

This application claims priority to Chinese Patent Application No. 202011518616.X entitled "A SEALING ASSEMBLY FOR DISSOLVABLE BRIDGE PLUG, A DISSOLVABLE BRIDGE PLUG AND A SEALING METHOD FOR GAP" and filed on Dec. 21, 2020, and Chinese Patent Application No. 202023099627.7 entitled "A SEALING ASSEMBLY FOR DISSOLVABLE BRIDGE PLUG AND A DISSOLVABLE BRIDGE PLUG" and filed on Dec. 21, 2020, which are incorporated herein by reference in its entirety and for all purposes.

FIELD OF THE INVENTION

The disclosure relates to oil and gas exploitation, and more specifically to a sealing assembly for dissolvable bridge plug, a dissolvable bridge plug provided with the sealing assembly for dissolvable bridge plug, and a sealing method for a gap between the dissolvable bridge plug and a casing.

BACKGROUND OF THE INVENTION

Bridge plug is a kind of plugging tool for oil and gas wells, which can plug the current oil and gas production layer, so as to facilitate the implementation of process measures for other oil and gas production layers. After completion of the process, the temporary plugging can be removed, establishing a flow channel between the production layer and the wellbore, and realizing the oil and gas production of oil and gas wells.

The sealing assembly is an important component of a bridge plug for sealing the gap between the bridge plug and the casing. The bridge plug disclosed in Chinese invention patent application No. 201610868106.2 provides a sealing assembly, which includes an upper variable-diameter support ring, a sealant rubber cylinder and a lower variable-diameter support ring. The upper variable-diameter support ring and the lower variable-diameter support ring each includes two ring components. When the seal assembly is subjected to axial pressure, the upper variable-diameter support ring, the sealant rubber cylinder and the lower variable-diameter support ring are deformed in the radial direction and expanded to be closely butted with the casing where the bridge plug is located, the upper variable-diameter support ring, the sealant rubber cylinder and the lower variable-diameter support ring can plug, or seal, the gap between the inner central channel of the bridge plug and the casing.

The applicant finds that there are at least the following technical problems in the prior art:

In the prior art, sealing of a dissolvable bridge plug is mainly realized by a sealing body composed of variable-diameter support rings and a dissolvable rubber cylinder, wherein the variable-diameter support rings are designed with a plurality of forked branches. When the dissolvable bridge plug is set in the casing, the variable-diameter support rings and the dissolvable rubber cylinder are extruded and expanded to seal the gap between the dissolvable bridge plug and the wellbore. The dissolvable bridge plug degrades with the time of entering the well, and sizes of the variable-diameter support rings also become smaller with the time of entering the well, resulting in weakening of the strength of the sealing body, which can no longer meet the requirement that the dissolvable bridge plug should be capable of maintaining performance for more than 24 hours in the well during fracturing operations. Therefore, there are technical problems of poor sealing durability and poor temperature adaptability.

SUMMARY OF THE INVENTION

The disclosure provides a sealing assembly for dissolvable bridge plug, a dissolvable bridge plug provided with the sealing assembly for dissolvable bridge plug and a sealing method for sealing a gap between the dissolvable bridge plug and a casing, which can solve the technical problems of poor sealing durability and poor temperature adaptability existing in the prior art.

Embodiments of the disclosure provides at least the following technical solutions:

The first aspect of the present disclosure provides a sealing assembly for dissolvable bridge plug comprising a seal ring and a support ring. The stiffness of the support ring is stronger than the stiffness of the seal ring. The support ring includes at least two supporting parts capable of sliding in the radial direction relative to each other, and an axial end face of the support ring is butted with an axial end face of the seal ring. Respective central holes of the support ring and the seal ring are capable of being sleeved outside a component (preferably a support cone) placed on a central rod of the dissolvable bridge plug. When the support ring is subjected to an axial thrust in a direction towards the seal ring and a radial thrust from inside to outside (away from the axial line), the supporting parts of the support ring are capable of sliding in a radial direction to expansion state, and the supporting parts of the support ring in expansion state are capable of exerting an axial thrust on the seal ring to prevent deformation of the seal ring in an axial direction and prevent leakage of dissolved matter generated from the seal ring.

Preferable or optionally, the support ring is made of dissolvable or degradable material and is capable of preventing the seal ring from leaking before the support ring dissolves.

Preferable or optionally, the support ring is made of dissolvable or degradable metal material.

Preferable or optionally, the seal ring is made of dissolvable or degradable metal, or the seal ring is made of dissolvable or degradable rubber.

Preferable or optionally, the outer contours and/or inner contours of the cross sections of the supporting parts are O-shaped (or, it can be understood as rings) or C-shaped (or, it can be understood as rings with notch). An axial end face of each supporting part is provided with a sliding slope surface, and sliding slope surfaces of adjacent supporting parts are butted with each other.

Preferable or optionally, the number of the supporting parts included in the support ring is two or more. The portion with the largest thickness in the axial direction of one of two supporting parts is butted with the portion with the smallest thickness in the axial direction of another one of the two supporting parts.

The second aspect of the present disclosure provides a dissolvable bridge plug comprising a central rod and a sealing assembly for dissolvable bridge plug according to the first aspect of the present disclosure. The support ring and the seal ring of the sealing assembly for dissolvable bridge plug are sleeved outside a component (preferably a support cone) placed on a central rod of the dissolvable bridge plug.

Preferable or optionally, the dissolvable bridge plug comprising a support cone and an axial extruding part. The support cone is provided with a central hole and a lower outer conical surface, and the central hole of the support cone is sleeved on the central rod. Both the support ring and the seal ring are sleeved on the lower outer conical surface of the support cone, and the position of the seal ring is relatively closer to the position with the largest outer diameter of the lower outer conical surface. When the axial extruding part exerts axial thrust on the support ring and the seal ring to push the support ring and the seal ring to slide on the lower outer conical surface in a direction of increasing outer diameter, radial thrust from inside to outside exerted by the lower outer conical surface on the seal ring is capable of causing radial deformation of the seal ring and sealing a gap between the support cone and a casing in an oil and gas well when the dissolvable bridge plug is set in the casing. At the same time, radial thrust from inside to outside exerted by the lower outer conical surface on the support ring is capable of making the supporting parts of the support ring slide in the radial direction to expansion state, and the supporting parts of the support ring in expansion state are capable of exerting axial thrust on the seal ring in expansion state to prevent deformation of the seal ring in the axial direction and to prevent leakage of dissolved matter generated from the seal ring.

Preferable or optionally, the support cone is capable of preventing the seal ring from leaking before the support ring dissolves.

Preferable or optionally, an upper end face of the axial extruding part is provided with a limit flange, a port of the central hole of the support ring is provided with a limit groove matching with the limit flange, and the limit flange is embedded between the limit groove and the lower outer conical surface of the support cone.

Preferable or optionally, an inner wall of each of the support ring and the seal ring is provided with a sliding inner slope surface matching with the lower outer conical surface of the support cone.

Preferable or optionally, the axial extruding part is a lower slip. A port of a central hole of the lower slip is provided with an upper inner conical surface, and the upper inner conical surface is sleeved on the lower outer conical surface. An outer surface of the lower slip is provided with a plurality of lower anchor teeth. The bottom of the central rod is connected with a detachable support (or, it can be referred to as locking nut or release), the detachable support is provided with a plurality of limit convex teeth meshing with guide convex teeth on the lower slip with a meshing structure capable of making the lower part of the lower slip slide only in the radial direction. While the central rod pulls the detachable support to move upward, the detachable support pulls the lower slip to move upward together, and the lower slip expands gradually under joint action of the lower outer conical surface and the upper inner conical surface. When the dissolvable bridge plug is set, the lower anchor teeth of the lower slip are stuck in the casing, and the detachable support detaches from the central rod. And when the dissolvable bridge plug is set, at least the support cone, the lower slip, the support ring and the seal ring are set in the casing.

Preferable or optionally, the central rod is provided with a connecting shaft ring, the lower part of the connecting shaft ring is provided with a limit outer conical surface, and the upper end of the central hole of the support cone is provided with a limit inner conical surface matching with the limit outer conical surface. The upper end face of the support cone is also provided with a connecting flange, which is threadedly connected with the upper part of the connecting shaft ring. When the dissolvable bridge plug is set, the support cone, the lower slip, the support ring and the seal ring are set in the casing, and the seal ring, the support ring and the lower slip are between the support cone and the casing.

Preferable or optionally, the lower slip includes a plurality of tooth bases arranged around the axial line of the dissolvable bridge plug, and a plurality of lower anchor teeth are arranged on the outer wall of each tooth base (the structure of the lower slip excluding the lower anchor teeth is preferably an integrated structure, or one-piece structure). And there are gaps between adjacent tooth bases, which are bridged (or connected) by connecting ribs. Guide convex teeth are located on the tooth bases. When the lower slip expands to the setting position, the connecting ribs will be broken off, and the tooth bases drive the lower anchor teeth to be stuck in the casing where the dissolvable bridge plug is located.

Preferable or optionally, the central rod is provided with a connecting shaft ring, the connecting shaft ring is sleeved with a central cylinder, the upper part of the central cylinder is provided with a stop flange, and a portion of the central cylinder below the stop flange is sleeved with a pressure ring, an upper slip and a section of the support cone successively from top to bottom. The stop flange is butted with the upper end face of the pressure ring. Limit convex teeth on the pressure ring mesh with guide convex teeth on the upper slip with a meshing structure capable of making the upper part of the upper slip slide only in the radial direction. The support cone is also provided with an upper outer conical surface, the outer surface of the upper slip is provided with a plurality of upper anchor teeth, and a lower port of a central hole of the upper slip is provided with a lower end inner conical surface matching with the upper outer conical surface. When the central rod move upward, the pressure ring will press the upper slip to move downward, and the upper slip expands gradually in the radial direction under joint action of the upper outer conical surface of the support cone and the lower end inner conical surface. When the dissolvable bridge plug is set, the upper anchor teeth of the upper slip are stuck on an inner wall of the casing, and the central cylinder, the pressure ring, the upper slip, the support cone, the lower slip, the support ring and the seal ring are set in the casing.

Preferable or optionally, the upper slip includes a plurality of tooth bases arranged around the axial line of the dissolvable bridge plug. A plurality of upper anchor teeth are arranged on the outer wall of each tooth base (the structure of the upper slip excluding the upper anchor teeth is preferably an integrated structure, or one-piece structure). And there are gaps between adjacent tooth bases, which are bridged (or connected) by connecting ribs. Guide convex teeth are located on the tooth base. When the lower slip expands to the setting position, the connecting ribs will be broken off, and the tooth bases drive the upper anchor tooth to be stuck in the casing where the dissolvable bridge plug is located.

Preferable or optionally, the central cylinder is threadedly connected with the central rod, the upper outer conical surface is threadedly connected with the lower end inner conical surface, and an outer wall of the central cylinder is threadedly connected with an inner wall of the central hole of the upper slip. Anti-retraction tooth structures are arranged respectively between the lower outer conical surface of the support cone and the upper end inner conical surface of the lower slip, between the upper outer conical surface of the support cone and the lower end inner conical surface of the upper slip, and between the outer wall of the central cylinder and the inner wall of the central hole of the support cone, and the anti-retraction tooth structures are capable of preventing the support cone from returning back after moving up.

Preferable or optionally, the central rod is connected with a central cylinder, the upper part of the central cylinder is provided with a stop flange, and a portion of the central cylinder below the stop flange is sleeved with a pressure ring, an upper slip, the support cone and the axial extruding part successively from top to bottom. The upper part of the support cone is provided with an upper outer conical surface, and the upper outer conical surface matches the lower end inner conical surface at a port of a central hole of the upper slip. The seal ring and the support ring are sleeved on the lower outer conical surface of the support cone successively from top to bottom. The axial extruding part is a cone structure with a central hole, and the upper end face of the axial extruding part is pressed against the lower end face of the support ring. The stop flange is butted with the upper end face of the pressure ring. Limit convex teeth on the pressure ring mesh with guide convex teeth on the upper slip with a meshing structure capable of making the upper part of the upper slip slide only in the radial direction. A bottom end outer slope surface of the axial extruding part is sleeved with a lower slip, the lower slip and the upper slip respectively include a hoop and a plurality of tooth bases sleeved on the hoop, and an outer wall of each tooth base is provided with a plurality of anchor teeth. The bottom of the central rod is connected with a detachable support, and an end face of the detachable support is provided with a plurality of limit convex teeth, the limit convex teeth mesh with guide convex teeth on the lower slip with a meshing structure capable of making the lower slip expand only in the radial direction. While the central rod pulls the detachable support to move upward, the detachable support pulls the lower slip to move upward together, and the lower slip expands gradually under joint action of the bottom end outer slope surface of the axial extruding part and an upper port inner slope surface at a port of a central hole of the lower slip. The upper slip expands gradually under joint action of the upper outer conical surface of the support cone and a lower port inner slope surface at a port of a central hole of the upper slip. When the anchor teeth of the lower slip and the upper slip are respectively stuck on an inner wall of the casing, the detachable support detaches from the central rod, and the central cylinder, the pressure ring, the upper slip, the support cone, the seal ring, the support ring, the axial extruding part and the lower slip are jointly set in the casing, so that the dissolvable bridge plug is set.

Preferable or optionally, the central rod is provided with a connecting shaft ring. The outer diameter of the connecting shaft ring is larger than that of the central rod. The connecting shaft ring is threadedly connected with the central cylinder. The upper part of the central cylinder is provided with a stop flange. The pressure ring is threadedly connected with the central cylinder.

The third aspect of the present disclosure provides a method for sealing a gap between a dissolvable bridge plug according to the second aspect of the present dis and a casing. The axial extruding part exerting axial thrust on the support ring and the seal ring to push the support ring and the seal ring to slide on the lower outer conical surface in a direction of increasing outer diameter, radial thrust from inside to outside exerted by the lower outer conical surface on the seal ring causing radial deformation of the seal ring and sealing a gap between the support cone and a casing in an oil and gas well when the dissolvable bridge plug is set in the casing. At the same time, radial thrust from inside to outside exerted by the lower outer conical surface on the support ring making the supporting parts of the support ring slide in the radial direction to expansion state, and the supporting parts of the support ring in expansion state exerting axial thrust on the seal ring in expansion state to prevent the seal ring from deforming in the axial direction and to prevent (in a manner of shielding) the seal ring from leaking before the support ring dissolves.

Any of the above technical solutions can at least produce the following technical effects:

When the support ring of the sealing assembly is subjected to the axial thrust in the direction towards the seal ring and the radial thrust from inside to outside (in the direction away from the axial line), the supporting parts of the support ring are capable of sliding in the radial direction to expansion state. The supporting parts of the support ring in expansion state are capable of exerting axial thrust on the seal ring to prevent deformation of the seal ring in the axial direction and prevent leakage of dissolved matter generated from the seal ring. Compared with the variable-diameter support ring in the prior art, the support ring according to the present disclosure has better effects of supporting, shielding and sealing, and forms a more tight and reliable sealing matching relationship with the seal ring. As a result, it effectively reduces the possibility of leakage from the gap between the support ring and the casing after the dissolvable and degradable seal ring is pressed. At the same time, the gap between the support ring and a radial thrust application part (such as an axial extruding part) exerting a radial thrust from inside to outside (away from the axial line) to the seal ring gets smaller. Therefore, the technical problems of poor sealing durability and temperature adaptability in the prior art are solved.

In addition, the support ring of the disclosure only needs to exert axial thrust on the seal ring to prevent the seal ring from deformation in the axial direction. It is not necessary for the support ring to deform elastically and expand to a state of tightly butting and fitting with the casing. Therefore, it is not necessary for the support ring to have a large axial size. At the same time, a more significant progress is that the seal ring of the disclosure achieves sealing effect only by its elasticity (flexibility), it is not necessary for the seal ring to maintain a strong stiffness to extrude a viable-diameter support ring to deform and expand to a state of tightly butting and fitting with the casing. Therefore, the axial size of the seal ring can also be set smaller, and thus, the axial size of the bridge plug of the sealing assembly can also be set smaller.

BRIEF DESCRIPTION OF THE DRAWINGS

In order to explain the embodiments of the disclosure or the technical solution in the prior art more clearly, the drawings required in describing the embodiments or the prior art will be briefly introduced below. Obviously, the drawings in the following description are only some embodiments of the disclosure, and other drawings can be obtained according to these drawings by those of ordinary skill in the art without paying creative labor.

In the Figures: 1. Seal ring; 2. Support ring; 21. Supporting part; 210. Sliding slope surface; 211. Limit groove; 120. Sliding inner slope surface; 3. Central rod; 31. Connecting shaft ring; 32. Central cylinder; 321. Stop flange; 311. Limit outer conical surface; 41. Support cone; 411. Limit inner conical surface; 412. Connecting flange; 410. Lower outer conical surface; 420. Upper outer conical surface; 42. Axial extruding part; 421. Limit flange; 422. Bottom end outer slope surface; 43. Casing; 441. Upper inner conical surface; 442. Lower anchor tooth; 44. Detachable support; 440. Limit convex tooth; 443. Guide convex tooth; 444. Tooth base; 445. Connecting rib; 446. Lower end inner conical surface; 447. Upper anchor tooth; 448. Hoop; 45. Pressure ring; 46. Upper slip; 47. Anti-retraction tooth structure; 48. Lower slip; 481. Upper port inner slope surface.

DETAILED DESCRIPTION OF THE ENBODIMENTS

In order to make the objectives, the technical solutions and the advantages of the disclosure clearer, the technical solutions of the disclosure will be described in detail in combination with FIGS. 1-11. Obviously, the described embodiments are only some of the embodiments of the present disclosure, not all of them. Based on the embodiments of the disclosure, all other embodiments which can be obtained by ordinary technicians in the art without creative labor belong to the protection scope of the disclosure.

The disclosure provides a sealing assembly with small axial size, less parts or components, low material cost, excellent sealing effect and wide application range, and a dissolvable bridge plug provided with the sealing assembly.

Figure 1:
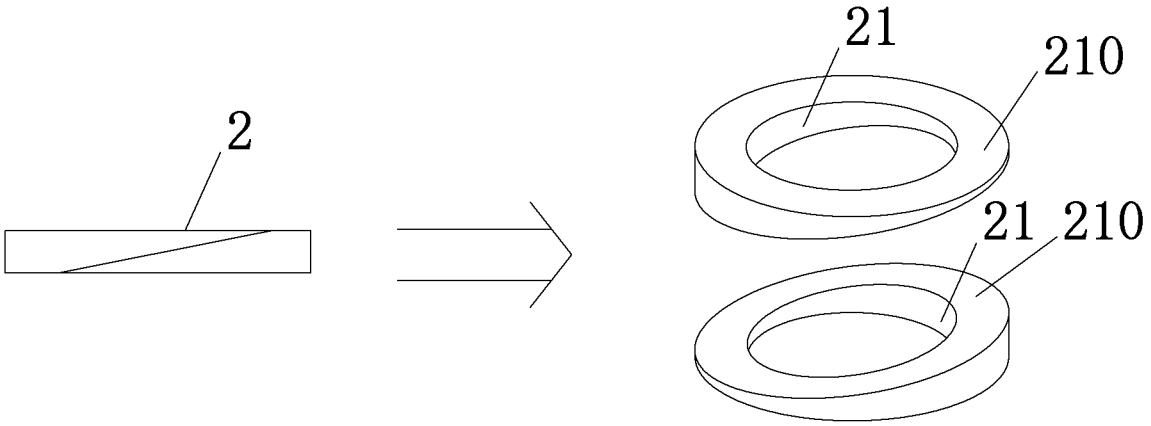
FIG. 1 is a disassembly diagram of a support ring composed of O-shaped supporting parts of a sealing assembly for dissolvable bridge plug according to an embodiment of the disclosure.
Figure 2:
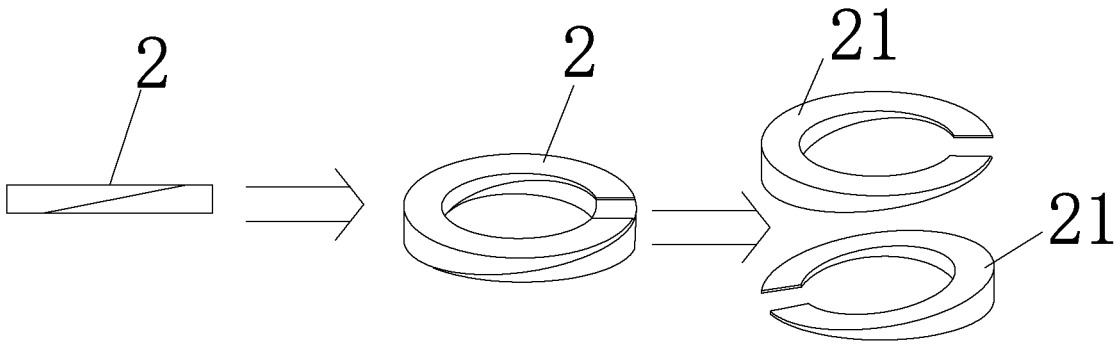
FIG. 2 is a disassembly diagram, from an initial state to a fractured state, of a support ring composed of C-shaped supporting parts or a support ring composed of O-shaped supporting parts of another sealing assembly for dissolvable bridge plug according to an embodiment of the disclosure.
Figure 3:
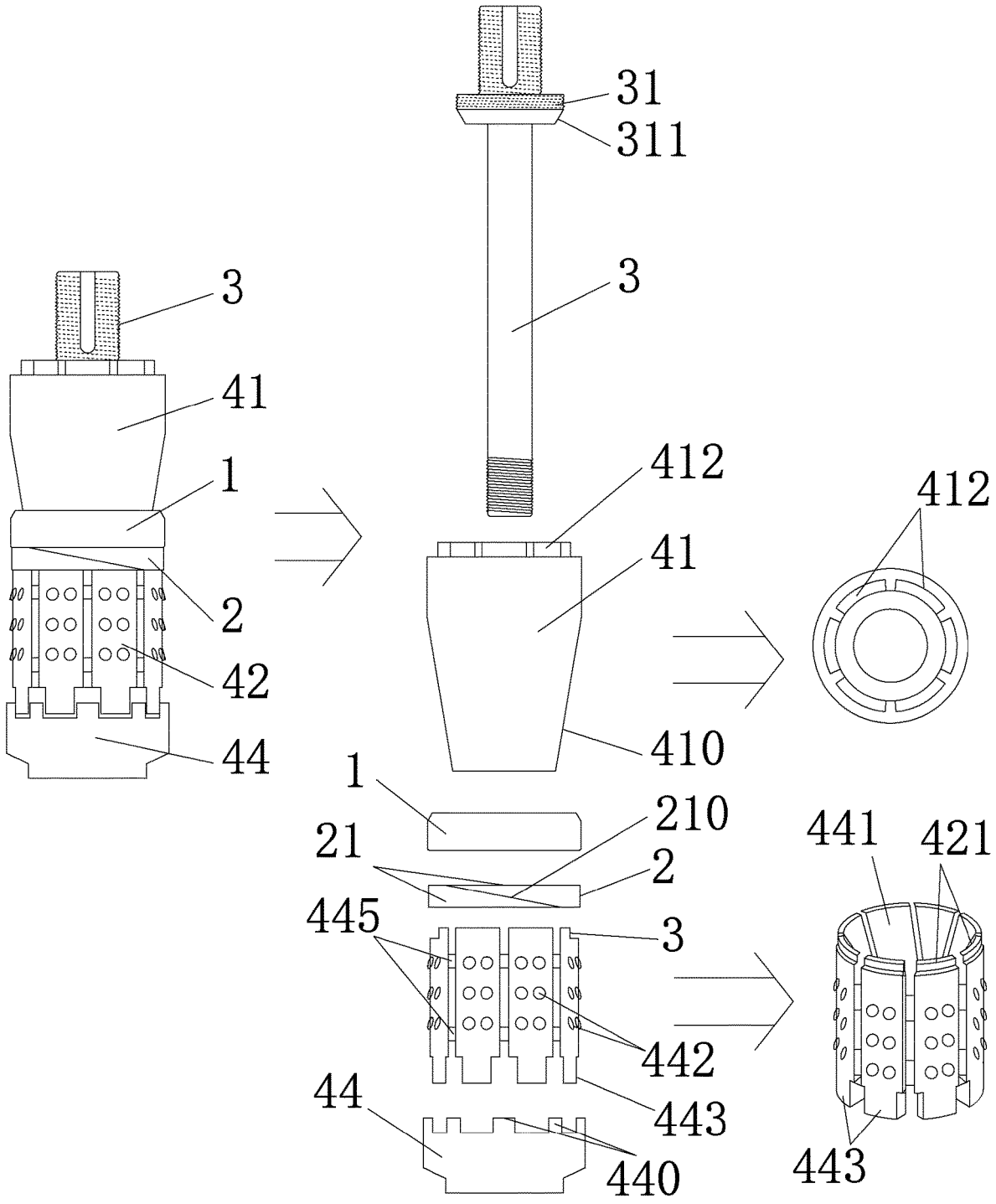
FIG. 3 is a disassembly diagram of a dissolvable bridge plug with a unidirectional integrated slip according to embodiment 1 of the disclosure.

As shown in FIG. 1 to FIG. 11, the sealing assembly for dissolvable bridge plug according to an embodiment of the disclosure includes a seal ring 1 as shown in FIG. 3 and a support ring 2 as shown in FIG. 1 and FIG. 2.

The stiffness of the support ring 2 is stronger than that of the seal ring 1. The material of the seal ring 1 can be the same or different from that of the existing sealant rubber cylinder.

The support ring 2 includes at least two supporting parts 21 capable of sliding in the radial direction relative to each other, and an axial end face of the support ring 2 is butted with an axial end face of the seal ring 1.

Respective central holes of the support ring 2 and the seal ring 1 are capable of being sleeved outside a component (preferably a support cone) on a central rod 3 of the dissolvable bridge plug.

When the support ring 2 is subjected to an axial thrust in the direction towards the seal ring 1 and a radial thrust from inside to outside (in the direction away from the axial line), its supporting parts 21 are capable of sliding in the radial direction to expansion state, and the supporting parts 21 of the support ring 2 in expansion state (at this time, the supporting parts 21 of the support ring 2 can be in a state of being fractured or pressed to open small gaps, and the gaps of the stacked supporting parts 21 are mutually staggered in the circumferential direction of the support ring 2, in other words, the gaps do not overlap in the axial direction) are capable of exerting axial thrust on the seal ring 1 to prevent the deformation of the seal ring 1 in the axial direction and prevent leakage of the dissolved matter generated from the seal ring.

In the sealing assembly according to the disclosure, when the support ring 2 is subjected to an axial thrust in the direction towards the seal ring 1 and a radial thrust from inside to outside (in the direction away from the axial line), its supporting parts 21 are capable of sliding in the radial direction to expansion state, and the supporting parts of the support ring 2 in expansion state (at this time, the supporting parts 21 of the support ring 2 can be in the state of being fractured or pressed to open small gaps, the gaps of the stacked supporting parts 21 are mutually staggered in the circumferential direction of the support ring 2, that is, the gaps do not overlap in the axial direction) are capable of exerting an axial thrust on the seal ring 1 to prevent the deformation of the seal ring 1 in the axial direction and prevent leakage of the dissolved matter generated from the seal ring. Therefore, compared with the variable-diameter support ring 2 in the prior art, the support ring 2 has better effects of supporting, shielding and sealing, and forms a more tight and reliable sealing matching relationship with the sealing ring. As a result, it effectively reduces the possibility of leakage from the gap between the support ring and the casing after the soluble and degradable sealing ring is pressed. At the same time, the gap between the support ring and a radial thrust application part (such as an axial extruding part) exerting a radial thrust from inside to outside (away from the axial line) to the seal ring gets smaller. Therefore, the technical problems of poor sealing durability and temperature adaptability in the prior art are solved.

In addition, the support ring 2 of the disclosure only needs to exert axial thrust on the seal ring 1 to prevent the seal ring 1 from deformation in the axial direction. It is not necessary for the support ring 2 to deform elastically and expand to a state of tightly butting and fitting with the casing 43. Therefore, it is not necessary for the support ring 2 to have a large axial size. At the same time, a more significant progress is that the seal ring 1 of the disclosure achieves sealing effect only by its elasticity (flexibility). It is not necessary for the seal ring 1 to maintain a strong stiffness to extrude a variable-diameter support ring 2 to deform and expand to a state of tightly butting and fitting with the casing 43. Therefore, the axial size of the seal ring 1 can be set smaller, and the axial size of the bridge plug provided with the sealing assembly can also be set smaller.

As an alternative implementation mode, the support ring 2 in this embodiment is made of dissolvable or degradable material and is capable of preventing leakage of the seal ring 1 before the support ring 2 dissolves. The support ring 2 made of dissolvable or degradable material will not block the fluid passage and will not hinder the oil and gas extraction.

As an alternative implementation mode, the support ring 2 in this embodiment is made of dissolvable or degradable metal material, and/or the seal ring 1 is made of dissolvable or degradable rubber. The support ring 2 is preferably made of the same material as parts of the bridge plug other than the seal ring 1, which is convenient for material acquisition and mass production.

As an alternative implementation mode, the outer contours and/or inner contours of the cross sections of the supporting parts 21 in this embodiment are O-shaped (or, it can be understood as rings) or C-shaped (or, it can be understood as rings with notch) as shown in FIG. 1, and an axial end face of each supporting part 21 is provided with a sliding slope surface 210, and sliding slope surfaces 210 of adjacent supporting parts 21 are butted with each other. The butting surface between the support ring 2 and the seal ring is preferably a flat surface. The design of the above-mentioned structure is convenient for the supporting parts 21 to slide in the radial direction to expansion state when is subjected an axial thrust in the direction towards the seal ring 1 and a radial thrust from inside to outside (away from the axial line). Of course, the sliding slope surface 210 can also be a cambered surface or a curved surface, as long as sliding can be realized, it is still within the protection scope of the present disclosure. As an alternative implementation mode, the number of supporting parts 21 included in the support ring 2 in this embodiment is preferably two (or three or more), and the portion with the largest thickness in the axial direction of one of the two supporting parts 21 is butted with the portion with the smallest thickness in the axial direction of another one of the two supporting parts.

The above-mentioned structure is compact, convenient for assembly, and easy to ensure that the overall thickness of the support ring 2 is consistent in the axial direction.

I. Dissolvable Bridge Plug Embodiment 1 (Unidirectional Integrated Slip)

Figure 4:
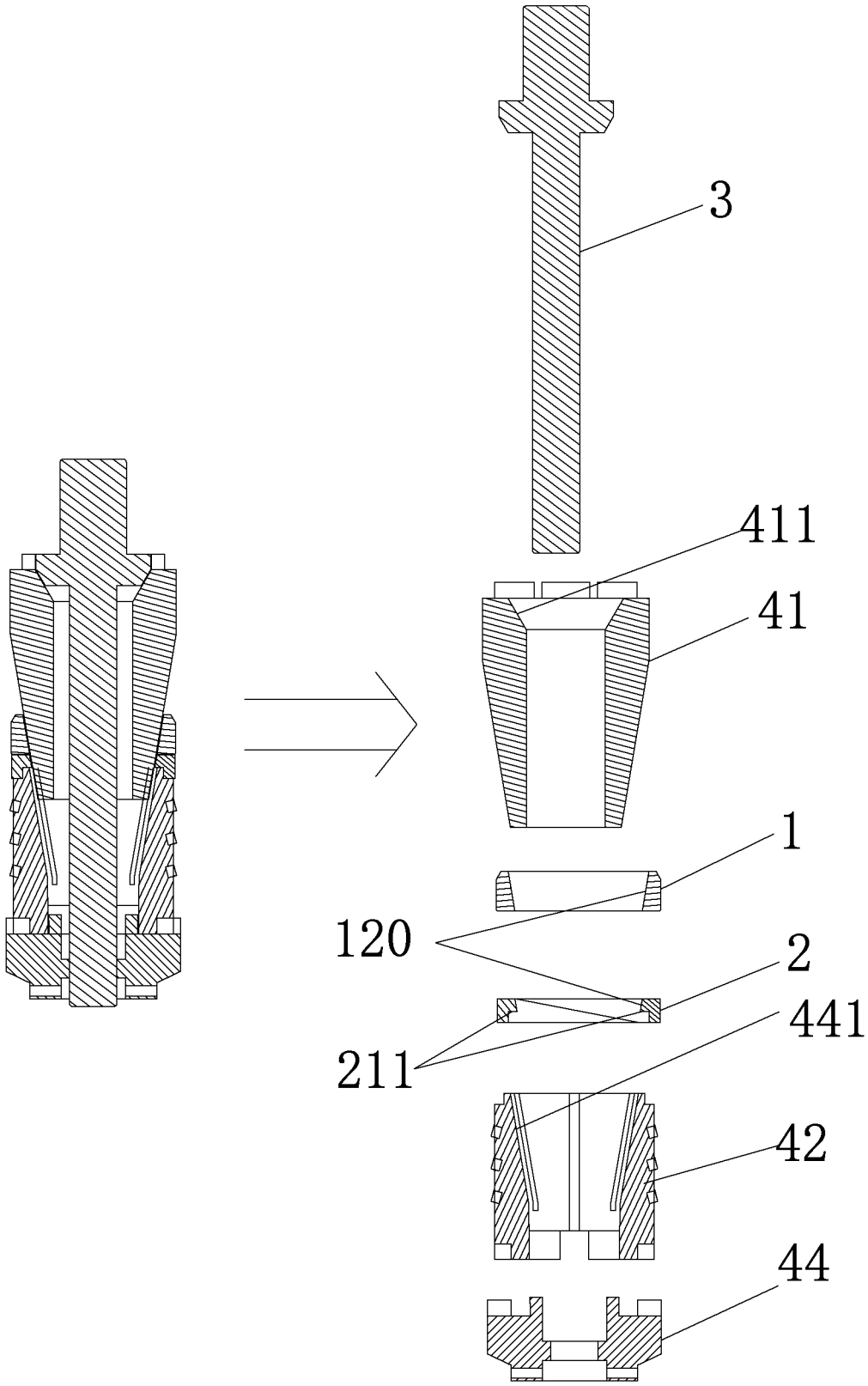
FIG. 4 is a disassembly sectional diagram of a dissolvable bridge plug with a unidirectional integrated slip according to embodiment 1 of the disclosure.
Figure 5:
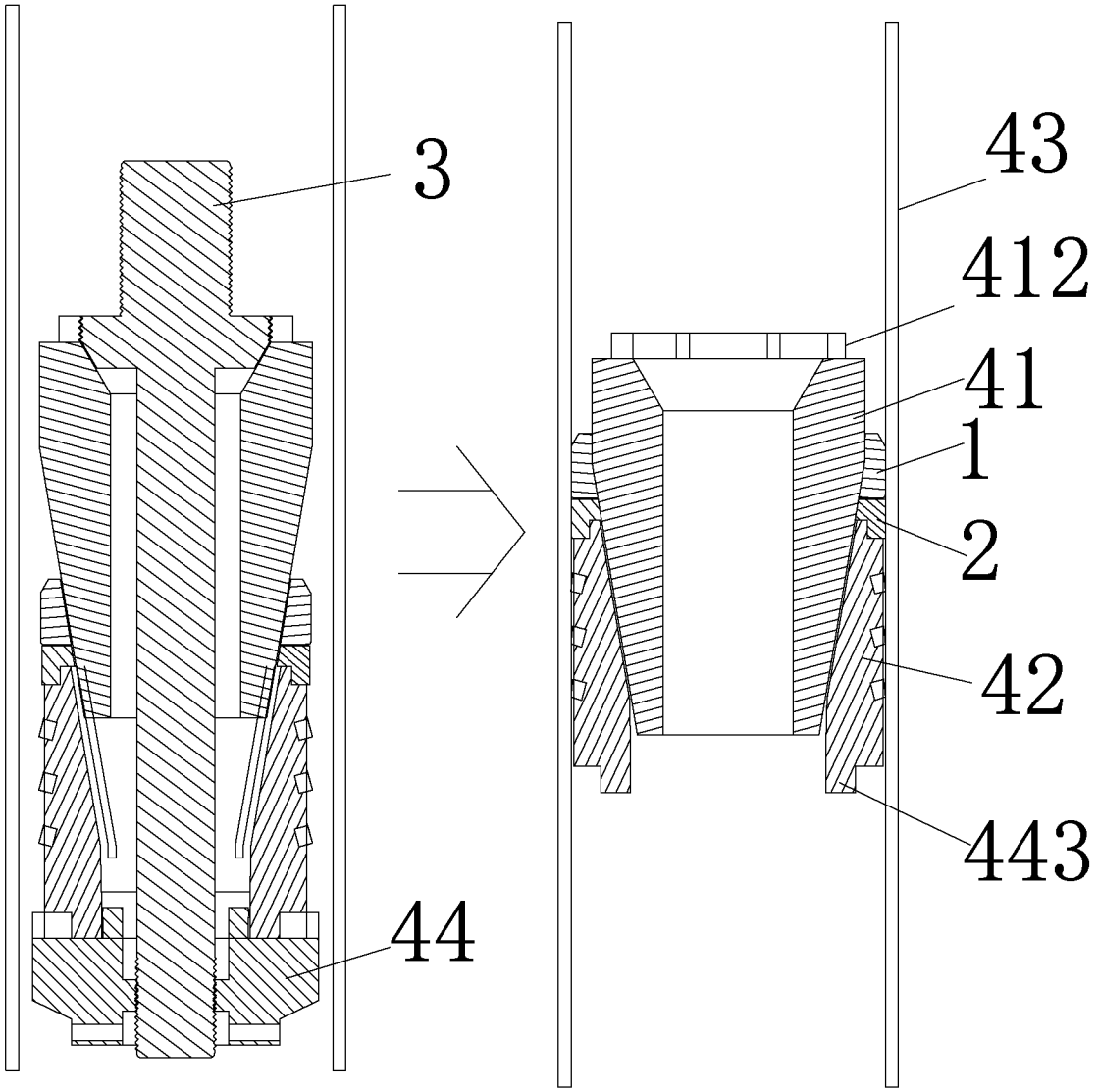
FIG. 5 is a schematic diagram of a dissolvable bridge plug with a unidirectional integrated slip according to embodiment 1 of the present disclosure during the procedure from an initial state to a setting state.

As shown in FIG. 3, FIG. 4 and FIG. 5, the dissolvable bridge plug according to an embodiment of the disclosure includes a central rod 3 and a sealing assembly for dissolvable bridge plug according to any technical solution of the disclosure. The support ring 2 and the seal ring 1 of the sealing assembly for dissolvable bridge plug are sleeved outside a component (preferably a support cone) placed on the central rod 3 of the dissolvable bridge plug. All parts or components of the dissolvable bridge plug are preferably made of dissolvable materials.

As an alternative implementation mode, the dissolvable bridge plug in this embodiment includes a support cone 41 and an axial extruding part 42.

The support cone 41 is provided with a central hole and a lower outer conical surface 410 (in the disclosure, all slope surfaces can be replaced by conical surfaces or curved surfaces with similar characteristics, such as cambered surfaces), and the central hole of the support cone 41 is sleeved on the central rod 3.

Both the support ring 2 and the seal ring 1 are sleeved on the lower outer conical surface 410 of the support cone 41, and the position of the seal ring 1 is relatively closer to the position with the largest outer diameter of the lower outer conical surface 410.

When the axial extruding part 42 exerts axial thrust on the support ring 2 and the seal ring 1 to push the support ring 2 and the seal ring 1 to slide on the lower outer conical surface 410 in the direction of increasing outer diameter, the radial thrust from inside to outside exerted by the lower outer conical surface 410 on the seal ring 1 is capable of causing radial deformation of the seal ring 1, and sealing a gap between the support cone 41 and a casing 43 in the oil and gas well when the dissolvable bridge plug is set in the casing 43.

At the same time, the radial thrust from inside to outside exerted by the lower outer conical surface 410 on the support ring 2 is capable of making the supporting parts 21 of the support ring 2 slide in the radial direction to expansion state, and the supporting parts 21 of the support ring 2 in expansion state (the supporting parts 21 of the support ring 2 can be in a state of being fractured or pressed to open small gaps at this time. The two diagrams on the right of the three diagrams in FIG. 2 can be used to illustrate the fracturing states of not only the O-shaped support ring 2 but also the C-shaped support ring 2) are capable of exerting axial thrust on the seal ring 1 in expansion state to prevent deformation of the seal ring 1 in the axial direction and prevent leakage of the dissolved matter generated from the seal ring 1.

The axial extruding part 42 not only exerts axial thrust on the support ring 2 and the seal ring 1, but also exerts radial thrust from inside to outside, so as to ensure synchronous deformation of the support ring 2 and the seal ring 1. When the dissolvable bridge plug is set on a casing 43 in an oil and gas well, the support ring 2 can exert axial thrust on the expanded seal ring 1 even if the support ring 2 is cracked or fractured, ensuring the sealing effect.

As an alternative implementation mode, the upper end face of the axial extruding part 42 is provided with a limit flange 421, a port of the central hole of the support ring 2 is provided with a limit groove 211 matching with the limit flange 421, and the limit flange 421 is embedded between the limit groove 211 and the lower outer conical surface 410 of the support cone 41.

The matching structure formed by the limit flange 421 and the limit groove 211 can reliably limit the support ring 2 and ensure that it will not be overturned due to pressure, thus ensuring that it can provide reliable support force for the seal ring 1.

As an alternative implementation mode, the inner wall of each of the support ring 2 and the seal ring 1 is provided with a sliding inner slope surface 120 matching with the lower outer conical surface 410 of the support cone 41. The tapers or slopes of the sliding inner slope surfaces 120 of the support ring 2 and the seal ring 1 are preferably the same.

The sliding inner slope surfaces 120 can ensure the stable expansion and sliding of the support ring 2 and the seal ring 1.

As an alternative implementation mode, the axial extruding part 42 is a lower slip. A port of the center hole of the lower slip is provided with an upper inner conical surface 441, and the upper inner conical surface 441 is sleeved on the lower outer conical surface 410. The outer surface of the lower slip is provided with a plurality of lower anchor teeth 442. The bottom of the central rod 3 is connected with a detachable support 44 (or, it can be referred to as locking nut or release) provided with a plurality of limit convex teeth 440, and the limit convex teeth 440 mesh with the guide convex teeth 443 on the lower slip with a meshing structure capable of making the lower part of the lower slip slide only in the radial direction.

When the central rod 3 pulls the detachable support 44 to move upward, the detachable support 44 will pull the lower slip upward together. Under the joint action of the lower outer conical surface 410 and the upper inner conical surface 441, the lower slip will expand gradually.

When the dissolvable bridge plug is set, the lower anchor tooth 442 of the lower slip is stuck in the casing 43, and the detachable support 44 detaches from the central rod 3.

When the dissolvable bridge plug is set, at least the support cone 41, the lower slip, the support ring 2 and the seal ring 1 are set in the casing 43.

As an alternative implementation mode, the central rod 3 is provided with a connecting shaft ring 31, the lower part of the connecting shaft ring 31 is provided with a limit outer conical surface 311, and the upper end of the central hole of the support cone 41 is provided with a limit inner conical surface 411 matching with the limit outer conical surface 311.

The upper end face of the support cone 41 is also provided with a connecting flange 412, which is threadedly connected with the upper part of the connecting shaft ring 31.

When the dissolvable bridge plug is set, the support cone 41, the lower slip, the support ring 2 and the seal ring 1 are set in the casing 43, and the seal ring 1, the support ring 2 and the lower slip are between the support cone 41 and the casing 43.

The above-described structure minimizes the number of the parts of the bridge plug remaining in the casing 43 after setting, greatly reduces the axial size of the bridge plug and the setting portion of the bridge plug, and expands the application scope of the bridge plug.

As an alternative implementation mode, the lower slip includes a plurality of tooth bases 444 arranged around the axial line of the dissolvable bridge plug, and a plurality of lower anchor teeth 442 are arranged on the outer wall of each tooth base 444 (the structure of the lower slip excluding the lower anchor teeth 442 is preferably an integrated structure, or one-piece structure). And there are gaps between adjacent tooth bases 444, which are bridged (or connected) by connecting ribs 445. Guide convex teeth 443 are located on the tooth bases 444. When the lower slip expands to the setting position, the connecting ribs 445 will be broken off, and the tooth bases 444 drive the lower anchor teeth 442 to be stuck in the casing 43 where the dissolvable bridge plug is located.

Preferably, the structure of the lower slip excluding the lower anchor tooth 442 is an one-piece structure, which has the advantage of convenient assembly. In this way, there is only one lower slip, and its anchoring force applied to the casing 43 is unidirectional, so it can be called as unidirectional integrated slip.

II. Dissolvable Bridge Plug Embodiment 2 (Bidirectional Integrated Slip)

Figure 6:
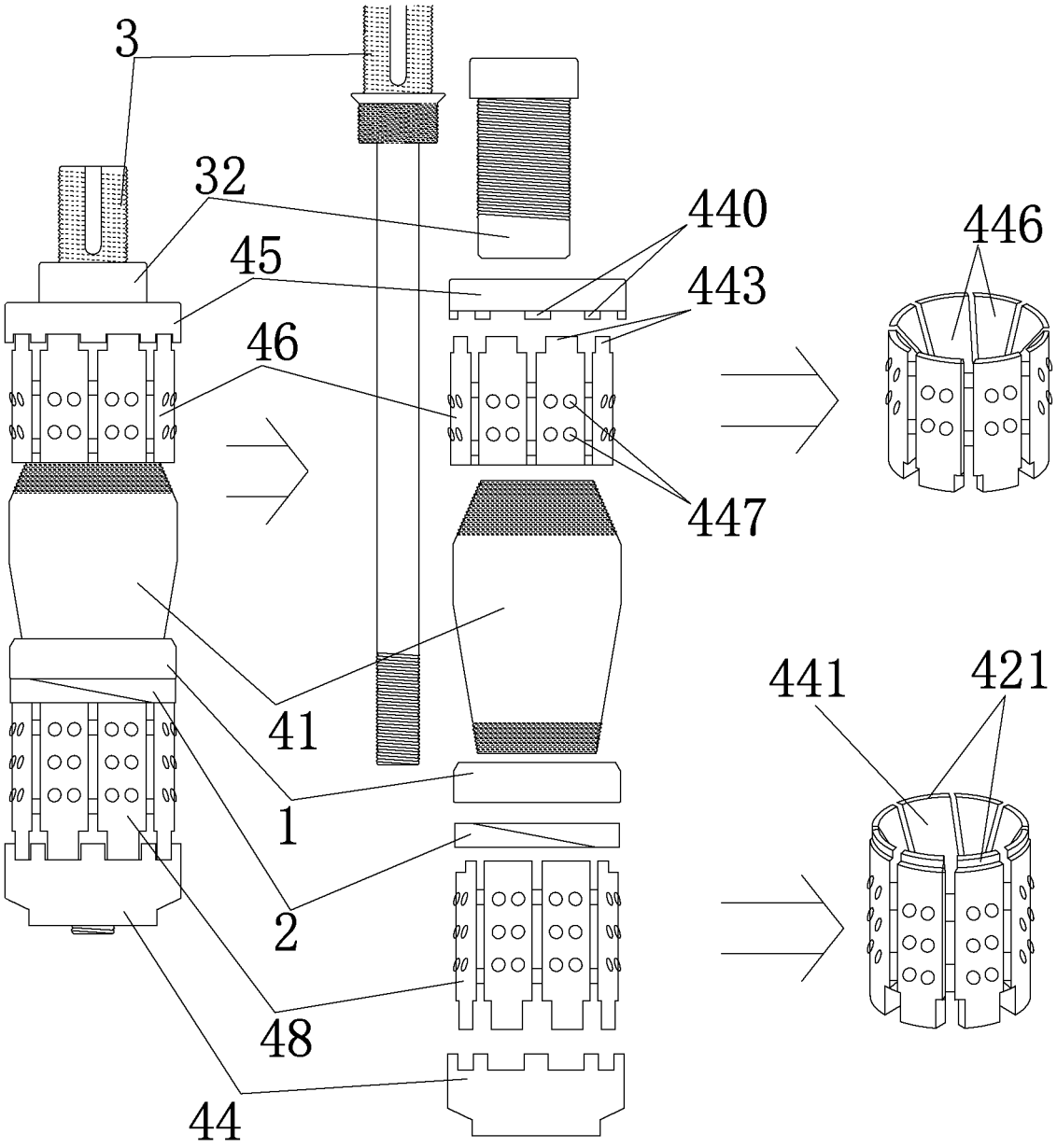
FIG. 6 is a disassembly diagram of a dissolvable bridge plug with a bidirectional integrated slip according to embodiment 2 of the disclosure.
Figure 7:
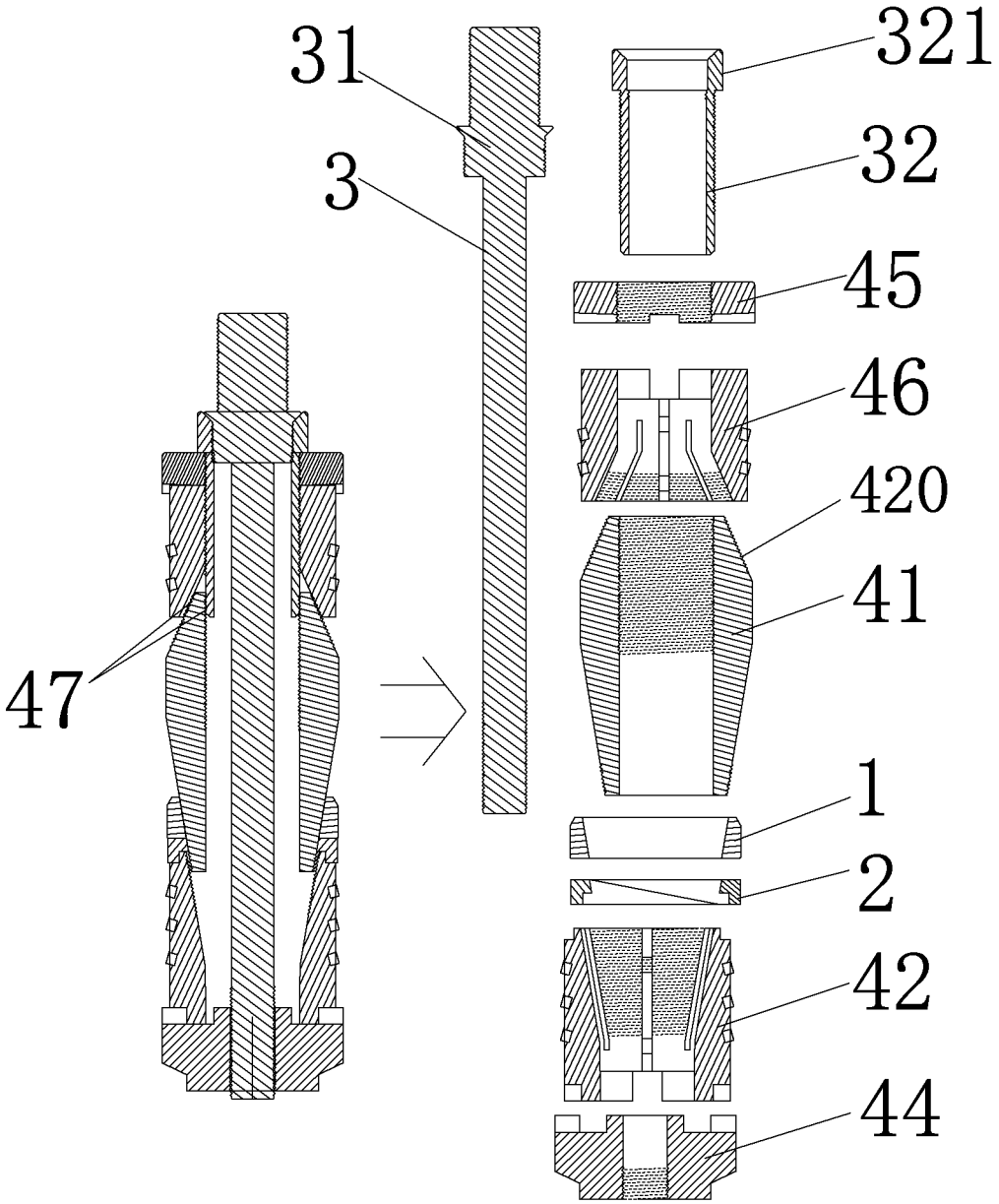
FIG. 7 is a disassembly sectional diagram of a dissolvable bridge plug with a bidirectional integrated slip according to embodiment 2 of the disclosure.
Figure 8:
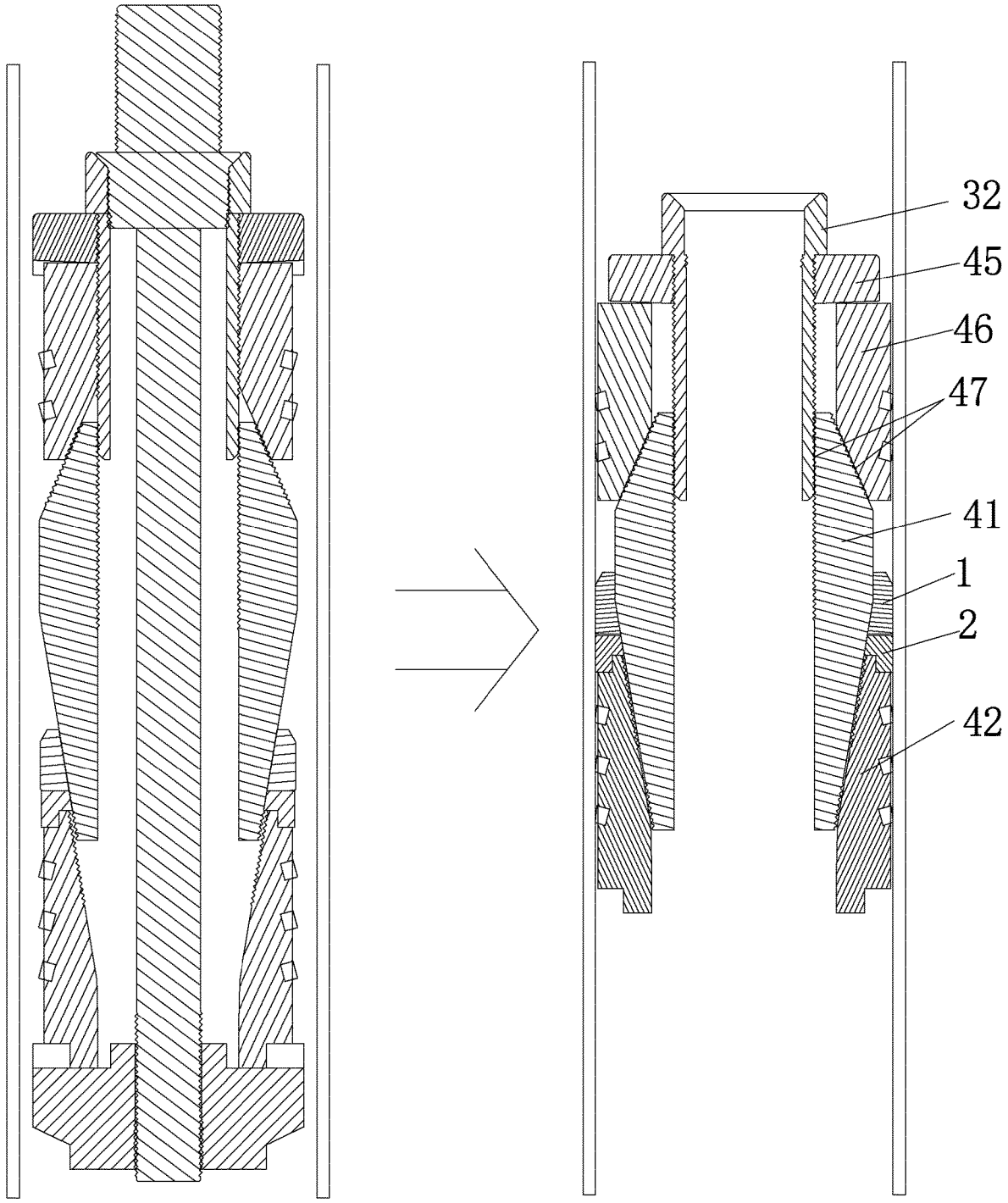
FIG. 8 is a schematic diagram of a dissolvable bridge plug with a bidirectional integrated slip according to embodiment 2 of the present disclosure during the procedure from an initial state to a setting state.

As shown in FIG. 6, FIG. 7 and FIG. 8, in this embodiment, the central rod 3 is provided with a connecting shaft ring 31, the connecting shaft ring 31 is sleeved with a central cylinder 32, the upper part of the central cylinder 32 is provided with a stop flange 321. The portion of the central cylinder 32 below the stop flange 321 is sleeved with a pressure ring 45, an upper slip 46 and a section of the support cone 41 successively from top to bottom.

The stop flange 321 is butted with the upper end face of the pressure ring 45.

The limit convex teeth 440 on the pressure ring 45 mesh with the guide convex teeth 443 on the upper slip 46 with a meshing structure capable of making the upper part of the upper slip 46 to slide only in the radial direction.

The support cone 41 is also provided with an upper outer conical surface 420, the outer surface of the upper slip 46 is provided with a plurality of upper anchor teeth 447, and the lower port of the center hole of the upper slip 46 is provided with a lower end inner conical surface 446 matching with the upper outer conical surface 420.

When the central rod 3 move upward, the pressure ring 45 will press the upper slip 46 to move downward, and the upper slip 46 expands gradually in the radial direction under the joint action of the upper outer conical surface 420 of the support cone 41 and the lower end inner conical surface 446.

When the dissolvable bridge plug is set, the upper anchor teeth 447 of the upper slip 46 are stuck on the inner wall of the casing 43, and the central cylinder 32, the pressure ring 45, the upper slip 46, the support cone 41, the lower slip 48, the support ring 2 and the seal ring 1 are set in the casing 43.

The respective anchor teeth of the upper slip 46 and the lower slip 48 are both stuck in the casing 43 to ensure the reliability of setting.

As an alternative implementation mode, the upper slip 46 includes a plurality of tooth bases 444 arranged around the axial line of the dissolvable bridge plug. A plurality of upper anchor teeth 447 are arranged on the outer wall of each tooth base 444 (the structure of the upper slip 46 excluding the upper anchor teeth 447 is preferably an integrated structure, or one-piece structure). And there are gaps between adjacent tooth bases 444, which are bridged (or connected) by connecting ribs 445. Guide convex teeth 443 are located on the tooth base 444. When the lower slip 48 expands to the setting position, the connecting ribs 445 will be broken off, and the tooth bases 444 drive the upper anchor tooth 447 to be stuck in the casing 43 where the dissolvable bridge plug is located.

The anchoring force exerted by the upper slip 46 and the lower slip 48 on the casing 43 is bidirectional, so it can be called as bidirectional integrated slip.

As an alternative implementation mode, the central cylinder 32 is threadedly connected with the central rod 3, the upper outer conical surface 420 is threadedly connected with the lower end inner conical surface 446, and the outer wall of the central cylinder 32 is threadedly connected with the inner wall of the central hole of the upper slip 46. Threaded connection has the advantages of compact structure and convenient assembly and disassembly.

Anti-retraction tooth structures 47 are arranged respectively between the lower outer conical surface 410 of the support cone 41 and the upper end inner conical surface 441 of the lower slip 48, between the upper outer conical surface 420 of the support cone 41 and the lower end inner conical surface 446 of the upper slip 46, and between the outer wall of the central cylinder 32 and the inner wall of the central hole of the support cone 41. The anti-retracting tooth structures 47 are capable of preventing the support cone 41 from returning back after moving up. The anti-retraction tooth structures 47 are preferably of ratchet structure, which are capable of preventing the support cone 41 from returning back after moving up, and thus ensuring the reliability of setting.

III. Dissolvable Bridge Plug Embodiment 3 (Bidirectional Combined Slip)

Figure 9:
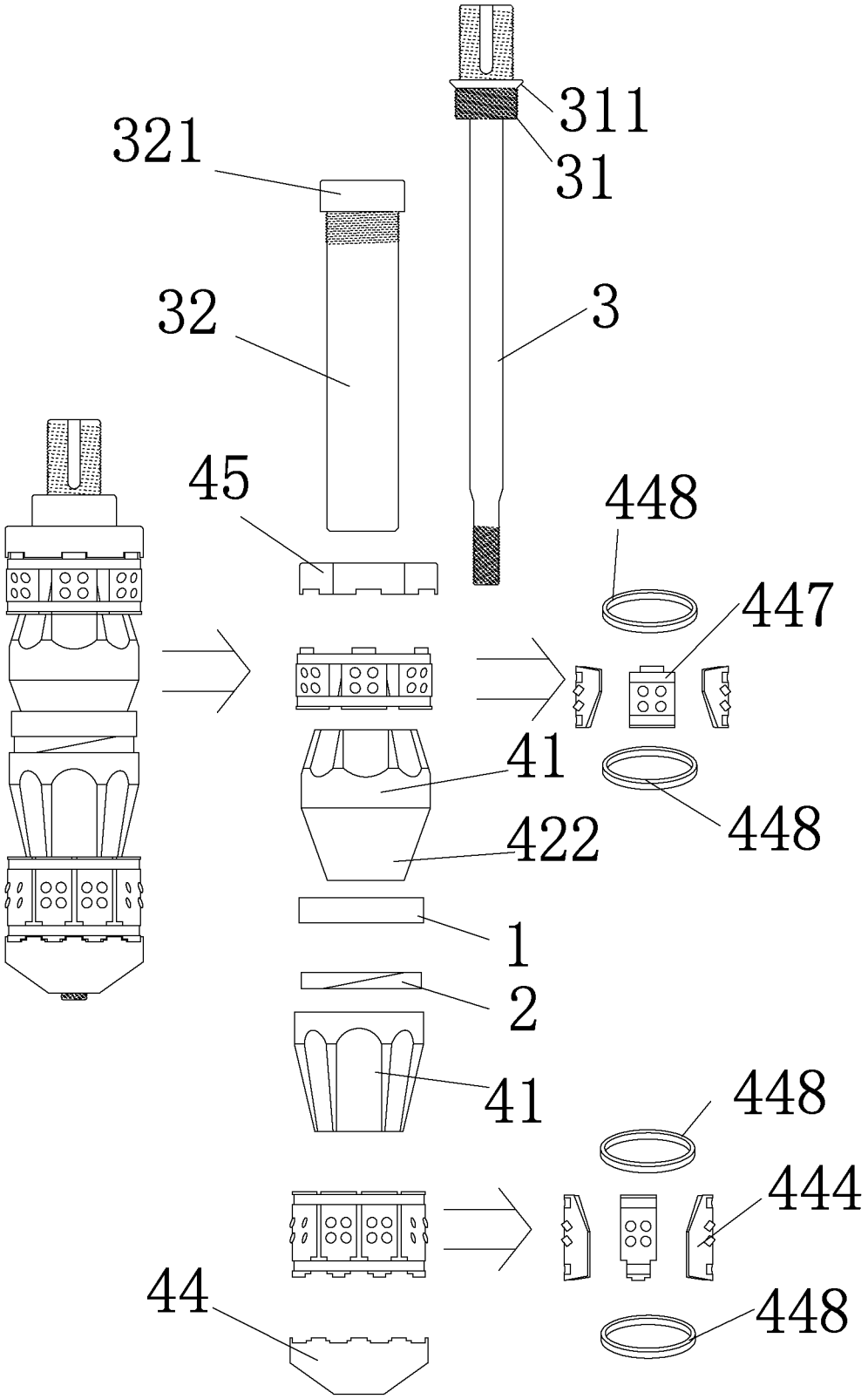
FIG. 9 is a disassembly diagram of a dissolvable bridge plug with a bidirectional combined slip according to embodiment 3 of the present disclosure.
Figure 10:
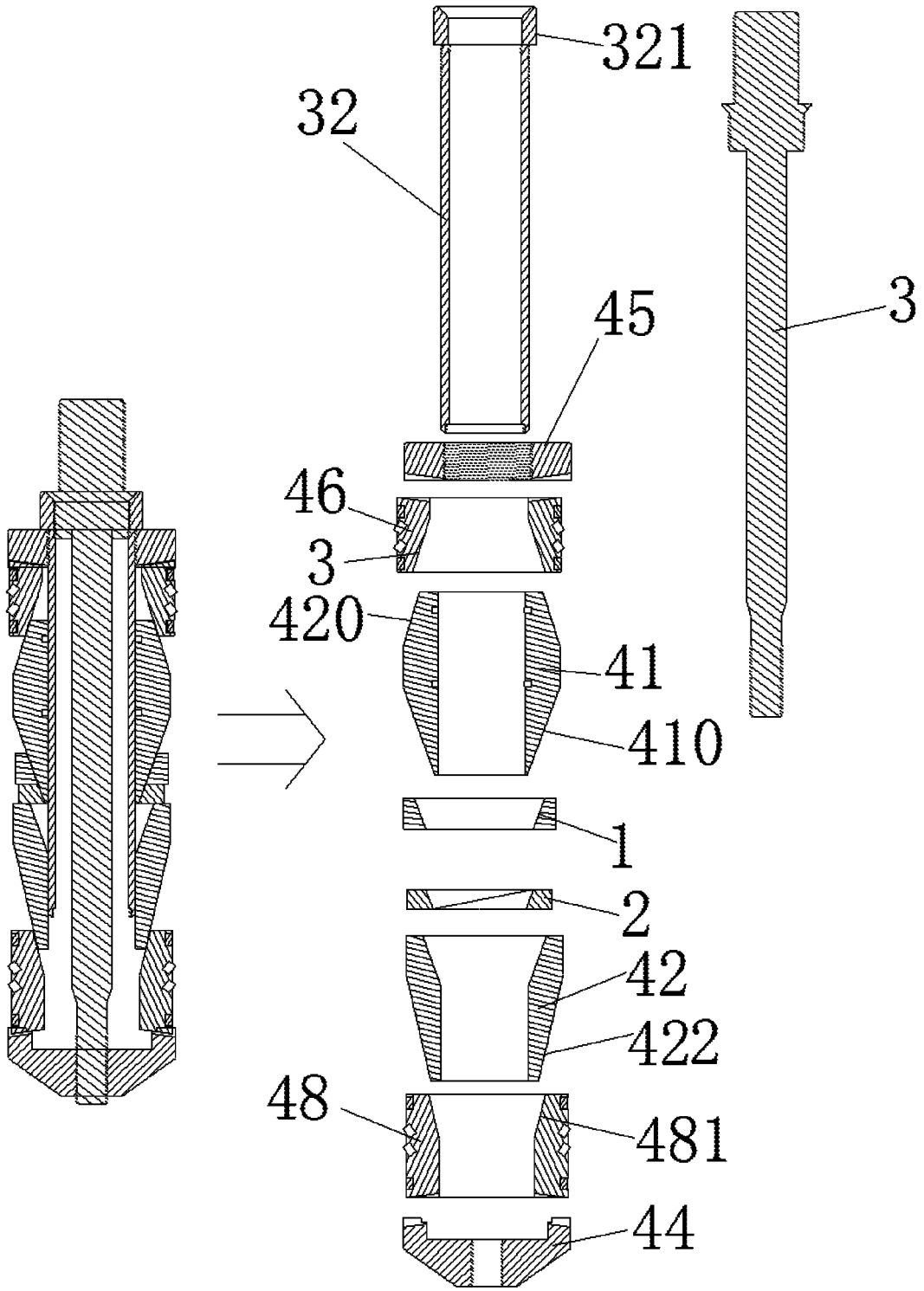
FIG. 10 is a disassembly sectional diagram of a dissolvable bridge plug with a bidirectional combined slip according to embodiment 3 of the present disclosure.
Figure 11:
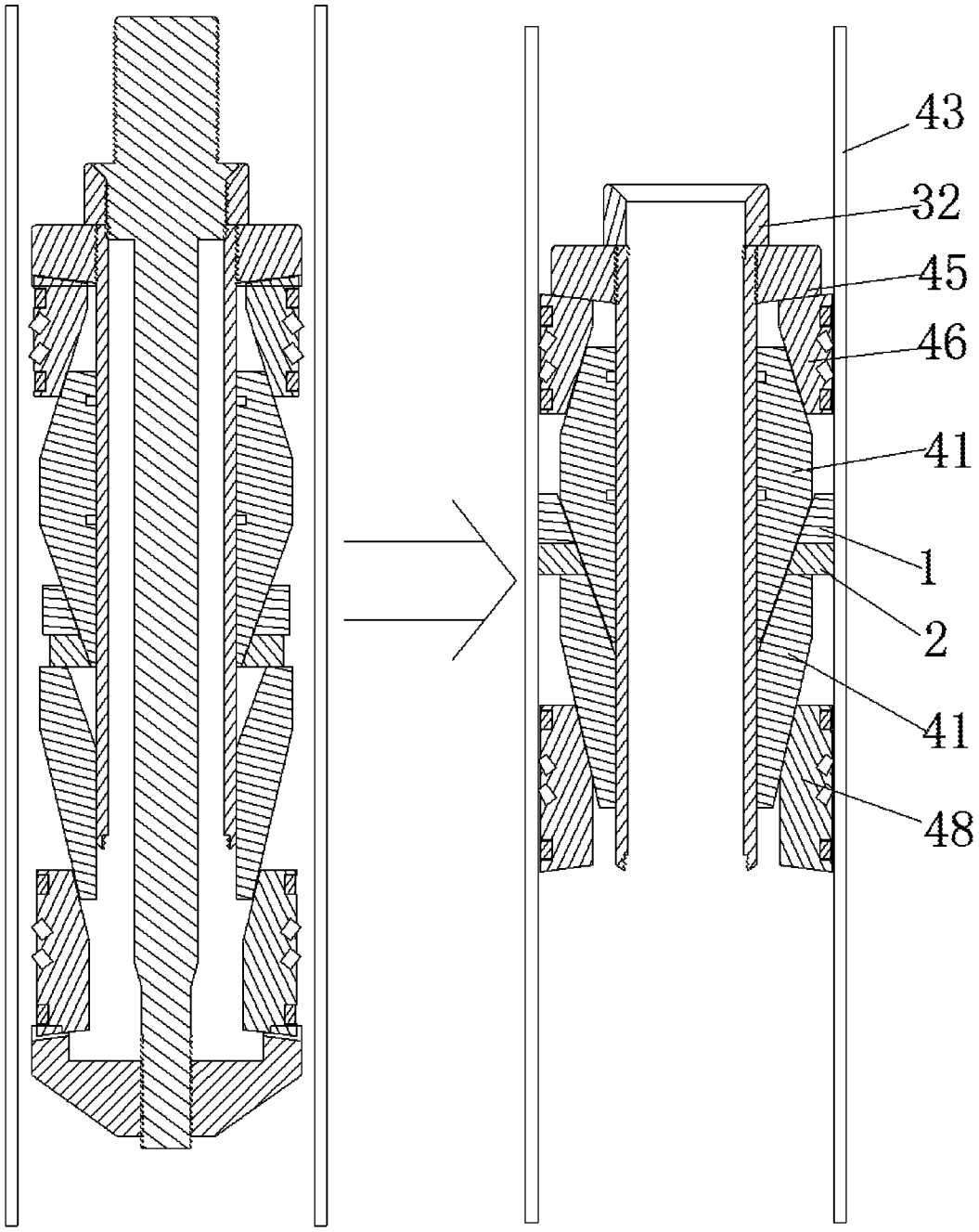
FIG. 11 is a schematic diagram of a dissolvable bridge plug with a bidirectional combined slip according to embodiment 3 of the present disclosure during the procedure from an initial state to a setting state.

As shown in FIG. 9, FIG. 10 and FIG. 11, in this embodiment, the central rod 3 is connected with a central cylinder 32, the upper part of the central cylinder 32 is provided with a stop flange 321. The portion of the central cylinder 32 below the stop flange 321 is sleeved with a pressure ring 45, an upper slip 46, a support cone 41 and an axial extruding part 42 successively from top to bottom.

The upper part of the support cone 41 is provided with an upper outer conical surface 420, which matches the lower end inner conical surface 446 at a port of the central hole of the upper slip 46.

The seal ring 1 and the support ring 2 are sleeved on the lower outer conical surface 410 of the support cone 41 successively from top to bottom.

The axial extruding part 42 is a cone structure with a central hole, and the upper end face of the axial extruding part 42 is pressed against the lower end face of the support ring 2.

The stop flange 321 is butted with the upper end face of the pressure ring 45.

The limit convex teeth 440 on the pressure ring 45 mesh with the guide convex teeth 443 on the upper slip 46 with a meshing structure capable of making the upper part of the upper slip 46 slide only in the radial direction.

The bottom end outer slope surface 422 of the axial extruding part 42 is sleeved with a lower slip 48. The lower slip 48 and the upper slip 46 respectively include a hoop 448 and a plurality of tooth bases 444 sleeved on the hoop 448. And the outer wall of each tooth base 444 is provided with a plurality of anchor teeth.

The bottom of the central rod 3 is connected with a detachable support 44, and the end face of the detachable support 44 is provided with a plurality of limit convex teeth 440. The limit convex teeth 440 mesh with the guide convex teeth 443 on the lower slip 48 with a meshing structure capable of making the lower slip 48 expand only in the radial direction.

While the central rod 3 pulls the detachable support 44 to move upward, the detachable support 44 will pull the lower slip 48 to move upward together.

Under the joint action of the bottom end outer slope surface 422 of the axial extruding part 42 and the upper port inner slope surface 481 at the port of the central hole of the lower slip 48, the lower slip 48 expands gradually.

Under the joint action of the upper outer cone surface 420 of the support cone 41 and the lower port inner slope surface at the port of the central hole of the upper slip 46, the upper slip 46 expands gradually.

When the anchor teeth of the lower slip 48 and the upper slip 46 are respectively stuck on the inner wall of the casing 43, the detachable support 44 detaches from the central rod 3, and the central cylinder 32, the pressure ring 45, the upper slip 46, the support cone 41, the seal ring 1, the support ring 2, the axial extruding part 42 and the lower slip 48 are jointly set in the casing 43, so that that the dissolvable bridge plug is set.

The structures of the lower slip 48 and the upper slip 46 in this embodiment are the same as those in the prior art (for example, the Chinese invention patent application No. 201610868106.2), and both are combined slips.

As an alternative implementation mode, the central rod 3 is provided with a connecting shaft ring 31. The outer diameter of the connecting shaft ring 31 is larger than that of the central rod 3. The connecting shaft ring 31 is threadedly connected with the central cylinder 32. The upper part of the central cylinder 32 is provided with a stop flange 321. The pressure ring 45 is threadedly connected with the central cylinder 32.

The above structure is beneficial to enlarge the inner diameter of the bridge plug. At the same time, the existence of the connecting shaft ring 31 enlarges the circumferential dimension of the central rod 3. Because the connecting shaft ring 31 only exists in a small section of the central rod 3 in the axial direction, the weight of the central rod 3 and the amount of the consumed material are reduced.

Further, an embodiment of the disclosure provides a sealing method for a gap between the dissolvable bridge plug provided by any of the above technical solutions according to the disclosure and a casing. The sealing method for the gap between the dissolvable bridge plug and the casing may be as follows.

The axial extruding part 42 exerts axial thrust on the support ring 2 and the seal ring 1 to push the support ring 2 and the seal ring 1 to slide on the lower outer conical surface 410 in the direction of increasing outer diameter. The radial thrust from inside to outside exerted by the lower outer conical surface 410 on the seal ring 1 causes radial deformation of the seal ring 1, and seals the gap between the support cone 41 and the casing 43 in the oil and gas well when the dissolvable bridge plug is set in the casing 43.

At the same time, the radial thrust from inside to outside exerted by the lower outer conical surface 410 on the support ring 2 makes the supporting parts 21 of the support ring 2 slide in the radial direction to expansion state, and the supporting parts 21 of the support ring 2 in expansion state (at this time, the supporting parts 21 of the support ring 2 can be in a state of being fractured or pressed to open small gaps, and the gaps of the stacked supporting parts 21 are mutually staggered in the circumferential direction of the support ring 2, in other words, t the gaps do not overlap in the axial direction) exerts an axial thrust on the seal ring 1 in expansion state to prevent the seal ring 1 from deforming in the axial direction and to prevent the seal ring 1 from leaking before the support ring 2 dissolves.

When the dissolvable bridge plug is set, an adapter of a bridge plug feeding tool can be used to pull or hold the central rod 3 upward (toward the wellhead direction). At the same time, a pushing tube (or outer tube) of the bridge plug feeding tool can be used to press or push the support cone 41 as shown in FIGS. 3 to 5 or the pressure ring 45 as shown in FIGS. 6 to 9 downward (toward the bottom hole direction), and pull the central rod 3 until the anchor teeth are stuck on the inner wall of the casing 43, pull out the central rod 3, the detachable support 44 detaches synchronously, and the dissolvable bridge plug can be set in the casing 43.

The above is only the specific implementation mode of the invention, but the protection scope of the invention should not be limited to this. Any person familiar with the technical field can easily think of change or replacement within the technical scope of the disclosure, which should be included in the protection scope of the invention. Therefore, the protection scope of the invention shall be subject to the protection scope of the claims.

What is claimed is:

1. A dissolvable bridge plug comprising a central rod, a support cone, an axial extruding part, a seal ring and a support ring, wherein the support cone is provided with a central hole and a lower outer conical surface, and the central hole of the support cone is sleeved on the central rod;

the stiffness of the support ring is stronger than the stiffness of the seal ring;

the support ring includes at least two supporting parts capable of sliding in the radial direction relative to each other, and an axial end face of the support ring is butted with an axial end face of the seal ring;

respective central holes of the support ring and the seal ring are sleeved on the lower outer conical surface of the support cone, and the position of the seal ring is relatively closer to the position with the largest outer diameter of the lower outer conical surface;

an upper end face of the axial extruding part is provided with a limit flange, a port of the central hole of the support ring is provided with a limit groove matching with the limit flange, and the limit flange is embedded between the limit groove and the lower outer conical surface of the support cone;

when the axial extruding part exerts axial thrust on the support ring and the seal ring to push the support ring and the seal ring to slide on the lower outer conical surface in a direction of increasing outer diameter, radial thrust from inside to outside exerted by the lower outer conical surface on the seal ring is capable of causing radial deformation of the seal ring and sealing a gap between the support cone and a casing in an oil and gas well when the dissolvable bridge plug is set in the casing;

at the same time, radial thrust from inside to outside exerted by the lower outer conical surface on the support ring is capable of making the supporting parts of the support ring slide in the radial direction to an expansion state, and the supporting parts of the support ring in the expansion state are capable of exerting axial thrust on the seal ring in the expansion state to prevent deformation of the seal ring in the axial direction and are capable of preventing leakage of dissolved matter generated from the seal ring.

2. The dissolvable bridge plug according to claim 1, wherein the support ring is made of dissolvable or degradable material and is capable of preventing the seal ring from leaking before the support ring dissolves.

3. The dissolvable bridge plug according to claim 1, wherein the support ring is made of dissolvable or degradable metal material; and/or the seal ring is made of dissolvable or degradable metal, or the seal ring is made of dissolvable or degradable rubber.

4. The dissolvable bridge plug according to claim 1, wherein the outer contours and/or inner contours of the cross sections of the supporting parts are O-shaped or C-shaped, and each supporting part is provided with a sliding slope surface in the axial direction, and sliding slope surfaces of adjacent supporting parts are butted with each other.

5. The dissolvable bridge plug according to claim 1, wherein the number of the supporting parts included in the support ring is two or more, and the portion with the largest thickness in the axial direction of one of two adjacent supporting parts is butted with the portion with the smallest thickness in the axial direction of another one of the two adjacent supporting parts.

6. The dissolvable bridge plug according to claim 1, wherein an inner wall of each of the support ring and the seal ring is provided with a sliding inner slope surface matching with the lower outer conical surface of the support cone.

7. The dissolvable bridge plug according to claim 1, wherein the axial extruding part is a lower slip, a port of a central hole of the lower slip is provided with an upper inner conical surface, and the upper inner conical surface is sleeved on the lower outer conical surface, an outer surface of the lower slip is provided with a plurality of lower anchor teeth, the bottom of the central rod is connected with a detachable support, the detachable support is provided with a plurality of limit convex teeth meshing with guide convex teeth on the lower slip with a meshing structure capable of making the lower part of the lower slip slide only in the radial direction, while the central rod pulls the detachable support to move upward, the detachable support pulls the lower slip to move upward together, and the lower slip expands gradually under joint action of the lower outer conical surface and the upper inner conical surface, when the dissolvable bridge plug is set, the lower anchor teeth of the lower slip are stuck in the casing, and the detachable support detaches from the central rod, and when the dissolvable bridge plug is set, at least the support cone, the lower slip, the support ring and the seal ring are set in the casing.

8. The dissolvable bridge plug according to claim 7, wherein the central rod is provided with a connecting shaft ring, the lower part of the connecting shaft ring is provided with a limit outer conical surface, and the upper end of the central hole of the support cone is provided with a limit inner conical surface matching with the limit outer conical surface;

the upper end face of the support cone is also provided with a connecting flange, which is threadedly connected with the upper part of the connecting shaft ring;

when the dissolvable bridge plug is set, the support cone, the lower slip, the support ring and the seal ring are set in the casing, and the seal ring, the support ring and the lower slip are between the support cone and the casing.

9. The dissolvable bridge plug according to claim 7, wherein the central rod is provided with a connecting shaft ring, the connecting shaft ring is sleeved with a central cylinder, the upper part of the central cylinder is provided with a stop flange, and a portion of the central cylinder below the stop flange is sleeved with a pressure ring, an upper slip and a section of the support cone successively from top to bottom, wherein:

the stop flange is butted with the upper end face of the pressure ring;

limit convex teeth on the pressure ring mesh with guide convex teeth on the upper slip with a meshing structure capable of making the upper part of the upper slip slide only in the radial direction;

the support cone is also provided with an upper outer conical surface, the outer surface of the upper slip is provided with a plurality of upper anchor teeth, and a lower port of a central hole of the upper slip is provided with a lower end inner conical surface matching with the upper outer conical surface;

when the central rod moves upward, the pressure ring will press the upper slip to move downward, and the upper slip expands gradually in the radial direction under joint action of the upper outer conical surface of the support cone and the lower end inner conical surface, when the dissolvable bridge plug is set, the upper anchor teeth of the upper slip are stuck on an inner wall of the casing, and the central cylinder, the pressure ring, the upper slip, the support cone, the lower slip, the support ring and the seal ring are set in the casing.

10. The dissolvable bridge plug according to claim 9, wherein the central cylinder is threadedly connected with the central rod, the upper outer conical surface is threadedly connected with the lower end inner conical surface, and an outer wall of the central cylinder is threadedly connected with an inner wall of the central hole of the upper slip;

anti-retraction tooth structures are arranged respectively between the lower outer conical surface of the support cone and the upper end inner conical surface of the lower slip, between the upper outer conical surface of the support cone and the lower end inner conical surface of the upper slip, and between the outer wall of the central cylinder and the inner wall of the central hole of the support cone, and the anti-retraction tooth structures are capable of preventing the support cone from returning back after moving up.

11. The dissolvable bridge plug according to claim 1, wherein the central rod is connected with a central cylinder, the upper part of the central cylinder is provided with a stop flange, and a portion of the central cylinder below the stop flange is sleeved with a pressure ring, an upper slip, the support cone and the axial extruding part successively from top to bottom, wherein:

the upper part of the support cone is provided with an upper outer conical surface, and the upper outer conical surface matches the lower end inner conical surface at a port of a central hole of the upper slip;

the seal ring and the support ring are sleeved on the lower outer conical surface of the support cone successively from top to bottom;

the axial extruding part is a cone structure with a central hole, and the upper end face of the axial extruding part is pressed against the lower end face of the support ring;

the stop flange is butted with the upper end face of the pressure ring;

limit convex teeth on the pressure ring mesh with guide convex teeth on the upper slip with a meshing structure capable of making the upper part of the upper slip slide only in the radial direction;

a bottom end outer slope surface of the axial extruding part is sleeved with a lower slip, the lower slip and the upper slip respectively include a hoop and a plurality of tooth bases sleeved on the hoop, and an outer wall of each tooth base is provided with a plurality of anchor teeth;

the bottom of the central rod is connected with a detachable support, and an end face of the detachable support is provided with a plurality of limit convex teeth, the limit convex teeth mesh with guide convex teeth on the lower slip with a meshing structure capable of making the lower slip expand only in the radial direction, while the central rod pulls the detachable support to move upward, the detachable support pulls the lower slip to move upward together, and the lower slip expands gradually under joint action of the bottom end outer slope surface of the axial extruding part and an upper port inner slope surface at a port of a central hole of the lower slip, the upper slip expands gradually under joint action of the upper outer conical surface of the support cone and a lower port inner slope surface at a port of a central hole of the upper slip;

when the anchor teeth of the lower slip and the upper slip are respectively stuck on an inner wall of the casing, the detachable support detaches from the central rod, and the central cylinder, the pressure ring, the upper slip, the support cone, the seal ring, the support ring, the axial extruding part and the lower slip are jointly set in the casing, so that the dissolvable bridge plug is set.

12. A dissolvable bridge plug comprising a central rod, a support cone, an axial extruding part, a seal ring and a support ring, wherein the support cone is provided with a central hole and a lower outer conical surface, and the central hole of the support cone is sleeved on the central rod;

the stiffness of the support ring is stronger than the stiffness of the seal ring;

the support ring includes at least two supporting parts capable of sliding in the radial direction relative to each other, and an axial end face of the support ring is butted with an axial end face of the seal ring;

respective central holes of the support ring and the seal ring are sleeved on the lower outer conical surface of the support cone, and the position of the seal ring is relatively closer to the position with the largest outer diameter of the lower outer conical surface;

when the axial extruding part exerts axial thrust on the support ring and the seal ring to push the support ring and the seal ring to slide on the lower outer conical surface in a direction of increasing outer diameter, radial thrust from inside to outside exerted by the lower outer conical surface on the seal ring is capable of causing radial deformation of the seal ring and sealing a gap between the support cone and a casing in an oil and gas well when the dissolvable bridge plug is set in the casing;

at the same time, radial thrust from inside to outside exerted by the lower outer conical surface on the support ring is capable of making the supporting parts of the support ring slide in the radial direction to an expansion state, and the supporting parts of the support ring in the expansion state are capable of exerting axial thrust on the seal ring in the expansion state to prevent deformation of the seal ring in the axial direction and are capable of preventing leakage of dissolved matter generated from the seal ring;

wherein, the axial extruding part is a lower slip, a port of a central hole of the lower slip is provided with an upper inner conical surface, and the upper inner conical surface is sleeved on the lower outer conical surface, an outer surface of the lower slip is provided with a plurality of lower anchor teeth, the bottom of the central rod is connected with a detachable support, the detachable support is provided with a plurality of limit convex teeth meshing with guide convex teeth on the lower slip with a meshing structure capable of making the lower part of the lower slip slide only in the radial direction, while the central rod pulls the detachable support to move upward, the detachable support pulls the lower slip to move upward together, and the lower slip expands under joint action of the lower outer conical surface and the upper inner conical surface, when the dissolvable bridge plug is set, the lower anchor teeth of the lower slip are stuck in the casing, and the detachable support detaches from the central rod, and when the dissolvable bridge plug is set, at least the support cone, the lower slip, the support ring and the seal ring are set in the casing.

13. The dissolvable bridge plug according to claim 12, wherein the central rod is provided with a connecting shaft ring, the lower part of the connecting shaft ring is provided with a limit outer conical surface, and the upper end of the central hole of the support cone is provided with a limit inner conical surface matching with the limit outer conical surface;

the upper end face of the support cone is also provided with a connecting flange, which is threadedly connected with the upper part of the connecting shaft ring;

when the dissolvable bridge plug is set, the support cone, the lower slip, the support ring and the seal ring are set in the casing, and the seal ring, the support ring and the lower slip are between the support cone and the casing.

14. The dissolvable bridge plug according to claim 12, wherein the central rod is provided with a connecting shaft ring, the connecting shaft ring is sleeved with a central cylinder, the upper part of the central cylinder is provided with a stop flange, and a portion of the central cylinder below the stop flange is sleeved with a pressure ring, an upper slip and a section of the support cone successively from top to bottom, wherein:

the stop flange is butted with the upper end face of the pressure ring;

limit convex teeth on the pressure ring mesh with guide convex teeth on the upper slip with a meshing structure capable of making the upper part of the upper slip slide only in the radial direction;

the support cone is also provided with an upper outer conical surface, the outer surface of the upper slip is provided with a plurality of upper anchor teeth, and a lower port of a central hole of the upper slip is provided with a lower end inner conical surface matching with the upper outer conical surface;

when the central rod moves upward, the pressure ring will press the upper slip to move downward, and the upper slip expands gradually in the radial direction under joint action of the upper outer conical surface of the support cone and the lower end inner conical surface, when the dissolvable bridge plug is set, the upper anchor teeth of the upper slip are stuck on an inner wall of the casing, and the central cylinder, the pressure ring, the upper slip, the support cone, the lower slip, the support ring and the seal ring are set in the casing.

15. The dissolvable bridge plug according to claim 14, wherein the central cylinder is threadedly connected with the central rod, the upper outer conical surface is threadedly connected with the lower end inner conical surface, and an outer wall of the central cylinder is threadedly connected with an inner wall of the central hole of the upper slip;

anti-retraction tooth structures are arranged respectively between the lower outer conical surface of the support cone and the upper end inner conical surface of the lower slip, between the upper outer conical surface of the support cone and the lower end inner conical surface of the upper slip, and between the outer wall of the central cylinder and the inner wall of the central hole of the support cone, and the anti-retraction tooth structures are capable of preventing the support cone from returning back after moving up.

16. The dissolvable bridge plug according to claim 12, wherein the support ring is made of dissolvable or degradable material and is capable of preventing the seal ring from leaking before the support ring dissolves.

17. The dissolvable bridge plug according to claim 12, wherein the support ring is made of dissolvable or degradable metal material; and/or the seal ring is made of dissolvable or degradable metal, or the seal ring is made of dissolvable or degradable rubber.

18. The dissolvable bridge plug according to claim 12, wherein the outer contours and/or inner contours of the cross sections of the supporting parts are O-shaped or C-shaped, and each supporting part is provided with a sliding slope surface in the axial direction, and sliding slope surfaces of adjacent supporting parts are butted with each other.

19. The dissolvable bridge plug according to claim 12, wherein the number of the supporting parts included in the support ring is two or more, and the portion with the largest thickness in the axial direction of one of two adjacent supporting parts is butted with the portion with the smallest thickness in the axial direction of another one of the two adjacent supporting parts.

20. The dissolvable bridge plug according to claim 12, wherein an inner wall of each of the support ring and the seal ring is provided with a sliding inner slope surface matching with the lower outer conical surface of the support cone.

* * * * *